US010557243B2

(12) United States Patent
Koffert et al.

(10) Patent No.: US 10,557,243 B2
(45) Date of Patent: Feb. 11, 2020

(54) ARRANGEMENT FOR SUPPORTING A STEEL PILE IN AN IMPACT PILE DRIVING DEVICE, AN IMPACT PILE DRIVING DEVICE, AN IMPACT PILE DRIVING MACHINE, AND A METHOD FOR ARRANGING THE SUPPORT OF A STEEL PILE IN AN IMPACT PILE DRIVING DEVICE

(71) Applicant: Junttan Oy, Kuopio (FI)

(72) Inventors: Markku Koffert, Kuopio (FI); Tuomo Heikkinen, Lukkarila (FI)

(73) Assignee: Junttan Oy, Kuopio (FI)

( * ) Notice: Subject to any disclaimer, the term of this patent is extended or adjusted under 35 U.S.C. 154(b) by 0 days.

(21) Appl. No.: 15/519,575

(22) PCT Filed: Oct. 16, 2015

(86) PCT No.: PCT/FI2015/050703

§ 371 (c)(1),
(2) Date: Apr. 17, 2017

(87) PCT Pub. No.: WO2016/059299

PCT Pub. Date: Apr. 21, 2016

(65) Prior Publication Data

US 2017/0268194 A1 Sep. 21, 2017

(30) Foreign Application Priority Data

Oct. 17, 2014 (FI) ..... 20145911

(51) Int. Cl.

| | |
|---|---|
| ***E02D 7/00*** | (2006.01) |
| ***E02D 13/10*** | (2006.01) |
| ***E02D 7/08*** | (2006.01) |
| ***E02D 5/28*** | (2006.01) |
| ***E02D 7/16*** | (2006.01) |

(52) U.S. Cl.

CPC ..... *E02D 7/00* (2013.01); *E02D 5/28* (2013.01); *E02D 7/08* (2013.01); *E02D 7/16* (2013.01); *E02D 13/10* (2013.01); *E02D 2200/1607* (2013.01); *E02D 2200/1628* (2013.01)

(58) Field of Classification Search

CPC . E02D 13/10; E02D 13/00; E02D 2200/1607; E02D 2200/1628; E02D 5/28; E02D 7/00; E02D 7/16

See application file for complete search history.

(56) References Cited

U.S. PATENT DOCUMENTS 1,178,143 A * 4/1916 Evans ..... E02D 13/10 173/131
2,053,508 A 9/1936 Barney et al.
(Continued)

FOREIGN PATENT DOCUMENTS

| | | |
|---|---|---|
| EP | 0059798 A1 | 9/1982 |
| SU | 1491965 A1 | 7/1989 |

OTHER PUBLICATIONS

Finnish Patent and Registration Office, Search report of the patent application FI-20145911, dated May 28, 2015.

*Primary Examiner* — Carib A Oquendo
(74) *Attorney, Agent, or Firm* — Berggren LLP

(57) ABSTRACT

The invention relates to an arrangement for supporting a thin-walled steel pile (5; 17; 26; 35) in an impact pile driving device, the arrangement comprising a supporting surface (4; 14; 23; 31), to which the steel pile (5; 17; 26; 35) can be supported, and in which arrangement the supporting surface (4; 14; 23; 31) is provided with one or more absorbing surfaces (6; 16; 25; 33) to be placed against the end of the wall (8; 18, 26; 36) of the steel pile (5; 17; 26; 35). In the arrangement according to the invention, the absorbing surface (6; 16; 25; 33) is configured to shape the end of the wall (8; 18; 27; 36) of the steel pile (5; 17, 26; 35) coming against the absorbing surface (6; 16; 25; 33), by the effect of the impact driving of the steel pile (5; 17; 26; 35), so that at least the part of the wall (8; 18; 27; 36) at the absorbing surface (6; 16; 25; 33) of the wall (8; 18; 27; 36) is shaped against the absorbing surface (6; 16; 25; 33), wherein the movement of the wall (8; 18; 27; 36) in the direction of a plane transverse to the direction of impact driving of the steel pile is prevented, at least at the head of the steel pile (5; 17; 26;
(Continued)

35). Also, the absorbing surface (6; 16; 25; 33) in the supporting surface (4, 14; 23; 31) can be configured to be shaped by the effect of the impact driving of the steel pile (5; 17, 26, 35) so that the absorbing surface (6; 16; 25; 33) is shaped against the part of the wall (8; 18, 27; 36) of the steel pile (5; 17; 26; 35) at the absorbing surface (6; 16; 25; 33), whereby the movement of the wall (8; 18; 27; 36) at the head of the steel pile (5; 17; 26; 35) is prevented. The invention also relates to a method for arranging the support of a steel pile (5; 17; 26; 35) in an impact pile driving device.

18 Claims, 4 Drawing Sheets

(56) References Cited

U.S. PATENT DOCUMENTS

| | | | | | |
|---|---|---|---|---|---|
| 3,975,918 | A * | 8/1976 | Jansz | E02D 13/00 | 173/DIG. 2 |
| 4,340,210 | A * | 7/1982 | Townsend | E02D 13/10 | 173/131 |
| 4,362,216 | A | 12/1982 | Jansz | | |
| 4,366,870 | A * | 1/1983 | Frederick | E02D 13/10 | 173/131 |
| 5,088,564 | A * | 2/1992 | Kobayashi | E02D 7/10 | 173/1 |
| 2010/0155093 | A1 * | 6/2010 | Desmeules | E21B 7/24 | 173/90 |

* cited by examiner

ARRANGEMENT FOR SUPPORTING A STEEL PILE IN AN IMPACT PILE DRIVING DEVICE, AN IMPACT PILE DRIVING DEVICE, AN IMPACT PILE DRIVING MACHINE, AND A METHOD FOR ARRANGING THE SUPPORT OF A STEEL PILE IN AN IMPACT PILE DRIVING DEVICE

FIELD OF THE INVENTION

The invention relates to an arrangement for supporting a steel pile in an impact pile driving device, an impact pile driving device, an impact pile driving machine, and a method for arranging the support of a pile in an impact pile driving device.

BACKGROUND OF THE INVENTION

The use of pile driving as a method of foundation of buildings and constructions has become widespread in recent years, for example because land for building is becoming sparse in the vicinity of many large cities, and piles driven into the ground can be used to provide a strong foundation even in areas where building is otherwise not possible because of the low bearing capacity of the soil. Furthermore, the development of more efficient pile driving machines used for driving piles, and the pile driving devices of the machines, as well as the decrease in the costs caused by pile driving, have made foundations based on pile driving less expensive and thereby more competitive than before, compared with alternative foundation solutions.

A factor that has conventionally limited the use of pile driving is that driving piles into the ground by hammering causes relatively loud noise which can be found intrusive in the immediate surroundings (for example in a residential area). In noise investigations on impact pile driving devices, the noise has been found to be produced in the hammer ram of the impact pile driving device when the massive part moving back and forth in connection with the frame of the hammer ram, that is, the block, hits a pile cap placed on top of the pile, which will transfer the impact to the pile to be driven into the ground, whereby intensive momentary deformation takes place in the walls of the pile, particularly in the case of steel piles. This sudden deformation will emit pronounced pressure variation, i.e. noise, to the environment. Without noise protection, the noise level in the vicinity of the impact pile driving device may exceed 100 decibel during the impact driving of the pile into the ground (particularly in the case of steel piles). This drawback has limited the use of impact pile driving particularly in areas where the noise has a very harmful effect, such as in densely populated residential areas. Naturally, the high noise level during the use of the impact pile driving device is also harmful to the operators of the impact pile driving device and other persons working on the construction site. Because of the noise, impact pile driving is often replaced by other pile driving methods which are less effective and more expensive, and which impose a heavier burden on the environment.

When concrete piles are driven, pile cushioning is used in pile driving devices of prior art for protecting the pile head from damage. These also have some effect on the vibration of the pile and thereby the generation of noise.

For reducing the noise level, various noise suppression solutions for impact pile driving devices have been developed. The aim has been to make the structures of the hammer ram as noise suppressing as possible, and noise reducing devices, to be installed around the pile to be driven into the ground, have been developed for suppressing the noise caused by the pile. According to tests and experiments made by the applicant, the solutions developed for the hammer ram have a limited effect. The use of noise reducing devices installed around the pile, in turn, involves the drawback that the pile remains invisible within the noise reducing device, whereby the pile driving operation cannot be followed visually. Moreover, the use of such a noise reducing device requires that the device is installed around the pile each time before starting the impact driving of a new pile into the ground. Naturally, this makes the whole pile driving process slower and more complicated.

BRIEF SUMMARY OF THE INVENTION

It is the aim of the invention to introduce a new arrangement for supporting particularly a steel pile in an impact pile driving device, whereby noise caused by impact driving of steel piles into the ground can be reduced in a way that is clearly simpler and more advantageous than the noise suppression solutions of prior art. The aim of the invention is also to introduce an impact pile driving device and an impact pile driving machine equipped with such a supporting arrangement, as well as a method for arranging the support of a pile in an impact pile driving device.

The aim of the invention is achieved by the supporting arrangement according to the invention, because the absorbing surface in the supporting surface abutting the steel pile is implemented so that by the effect of the impact driving of the pile it shapes the end of the wall of the pile and/or is itself shaped so that the absorbing surface and the wall of the pile are shaped against each other over the whole area, in which the end of the wall of the pile extends to the absorbing surface. Thus, the absorbing surface prevents the wall of the pile from moving in a direction crosswise to the driving direction, wherein it reduces crosswise vibration emitted by impact-like loads on the wall, caused by impact driving of the pile, and thereby the noise generated. To put it more precisely, the arrangement according to the invention for supporting a pile in an impact pile driving device is characterized by what is presented in claims 1 and 2; the impact pile driving device by what is presented in claim 12, the impact pile driving machine according to the invention by what is presented in claim 13, and the method for arranging the support for a pile in an impact pile driving device by what is presented in claims 14 and 15. Dependent claims 3 to 11 and 16 present some advantageous embodiments of the arrangement and the method according to the invention.

According to noise measurements taken on impact pile driving devices, significantly lower noise levels are achieved by the arrangement according to the invention, formed by the above described principles, than by impact pile driving devices equipped with supporting arrangements in which the end of the wall of the steel pile or the absorbing surface on the supporting surface is not shaped in such a way that the end of the steel pile is supported to the supporting surface in the above described way. In noise measurements taken on the impact pile driving device equipped with the supporting arrangement according to the invention, the sound pressure emitted to the environment during the pile driving was reduced by up to about 18 dB. This is an even greater reduction in the sound pressure level than the reduction in the sound pressure level achieved by means of, for example, a flexible noise reducing device fitted around a steel pile and the hammer ram, or by passive sound insulation solutions installed in the hammer ram.

It is worth noting that in the present patent application, the piles to be driven into the ground by an impact pile driving device are so-called steel piles which are typically made of steel plate profiles with a closed or open cross-sectional profile. Thus, the steel piles referred to in this application can be either piles formed of pipes with a circular, rectangular or another cross section, or piles formed of open profiles with a sheet structure, such as I, L, T, Z, or H profiles. Moreover, the steel piles referred to in this application can be steel piles with thin walls, formed of so-called sheet piling profiles. In this application, the term "steel pile" refers to piles made of sheet steel material which may be, for example, hot rolled or cold rolled sheet steel. Moreover, the steel pile is not limited in any way by the thickness of the wall of the pile, although the steel pile here refers to a pile which is hollow inside and has a wall thickness which is often quite small in relation to the outer dimensions (e.g. the diameter) of the pile.

DESCRIPTION OF THE DRAWINGS

In the following, the invention will be described in more detail with reference to the appended drawings, in which.

DETAILED DESCRIPTION OF SOME EMBODIMENTS OF THE INVENTION

Figure 1:
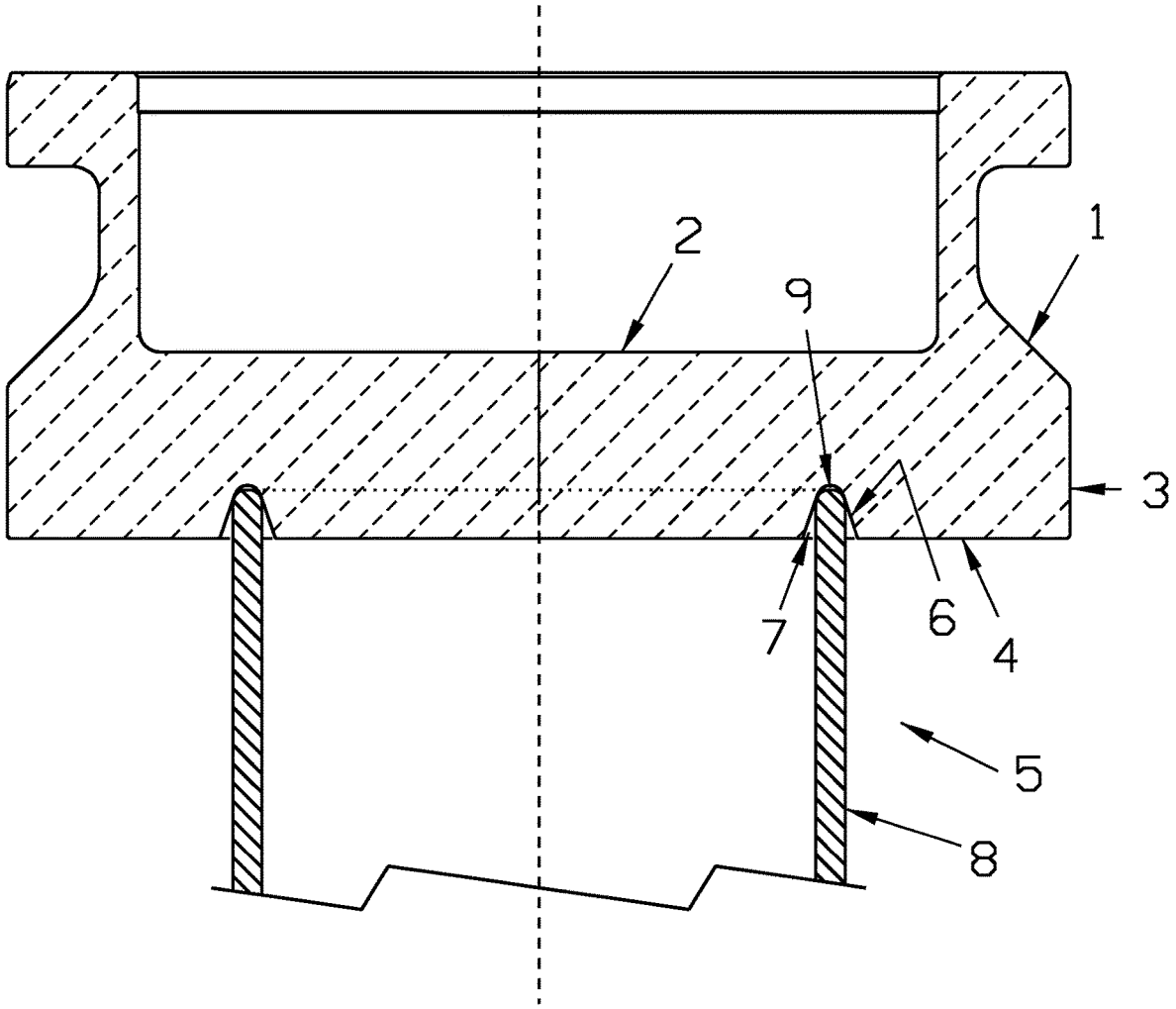
FIG. 1 shows the vertical cross-section of a cushion element in an impact pile driving device equipped with the arrangement according to the invention, the pile being supported to the cushion element.

In the embodiment according to FIG. 1, the cushion element is provided in an impact pile driving device mounted on a mobile machine typically equipped with a crawler track or wheels. In general and in this patent application, too, the impact pile driving device and the machine by which the impact pile driving device is moved to a desired location for driving a pile into the ground, are called an impact pile driving machine. Consequently, in this application, the term pile driving device refers primarily to the aggregate by which the driving of piles into the ground is actually carried out; in other words, when the pile driving device is mounted on the machine, the combination is called an impact pile driving machine in which said machine thus constitutes a so-called base machine.

The cushion element 1 for an impact pile driving device, shown in FIG. 1, is e.g. a metal piece having an impact surface 2, a side surface 3, and a supporting surface 4. The impact surface 2 is that surface of the cushion element which is hit by the block moving e.g. hydraulically or mechanically back and forth inside the hammer ram during impact pile driving. The side surface 3 is typically that face of the cushion element that abuts on the side walls of the cap of the cushion element in the lower part of the hammer ram. The supporting surface 4, in turn, is the surface which is placed against the top of the pile to be driven into the ground.

Figure 2:
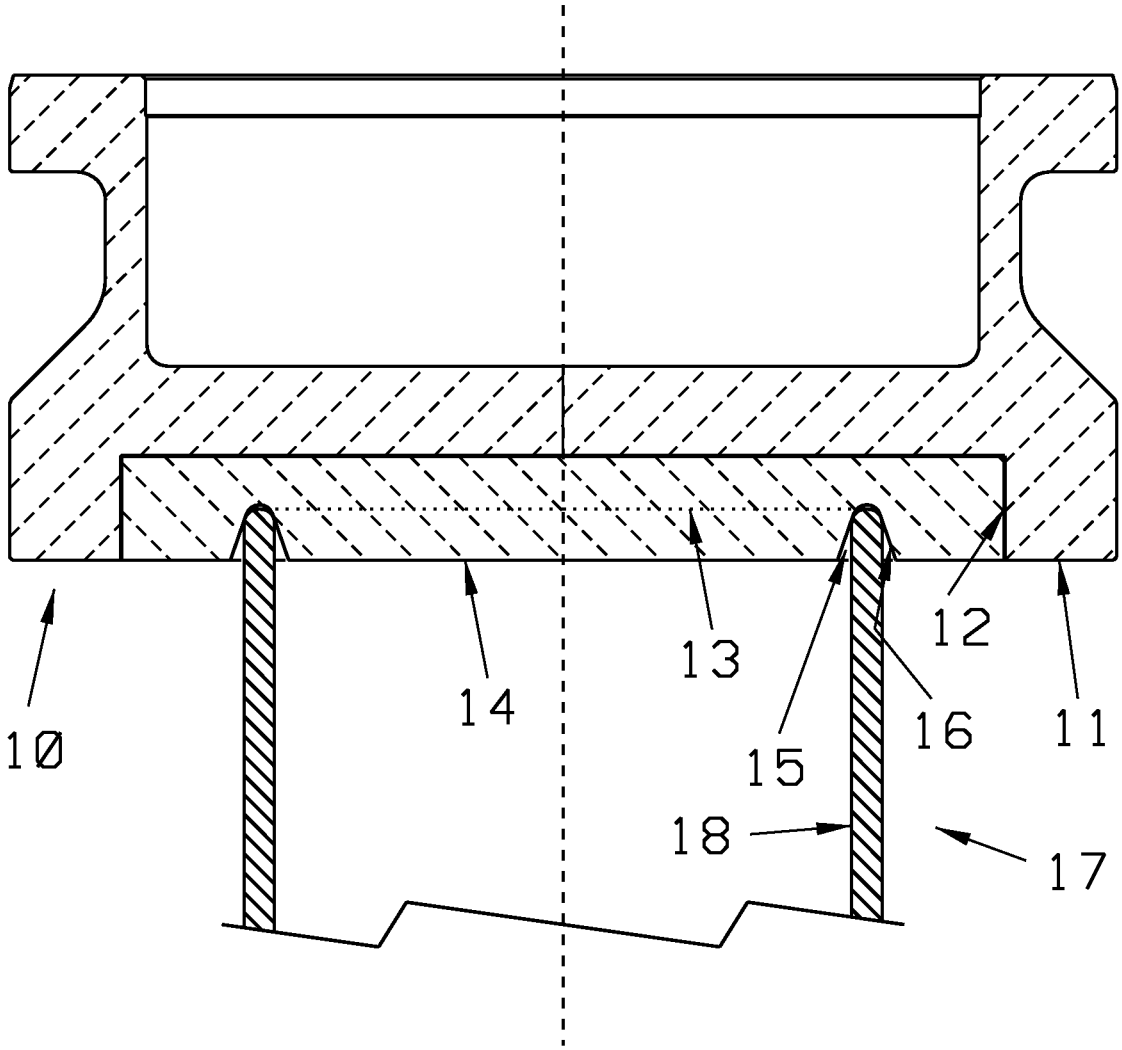
FIG. 2 shows the vertical cross-section of a cushion element in a second impact pile driving device equipped with the arrangement according to the invention, the pile being supported to the cushion element.
Figure 3:
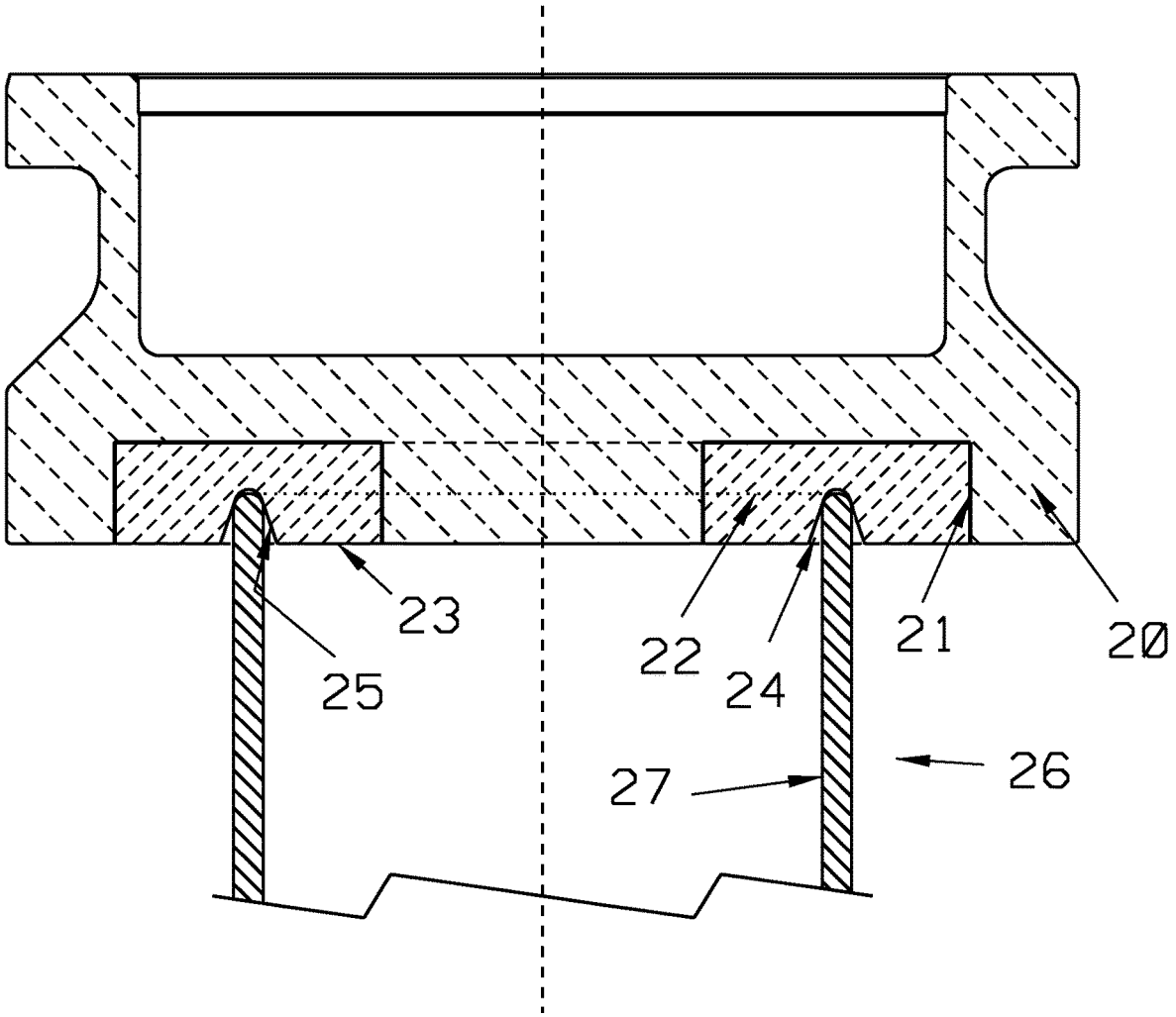
FIG. 3 shows the vertical cross-section of a cushion element in a third impact pile driving device equipped with the arrangement according to the invention, the pile being supported to the cushion element.
Figure 4:
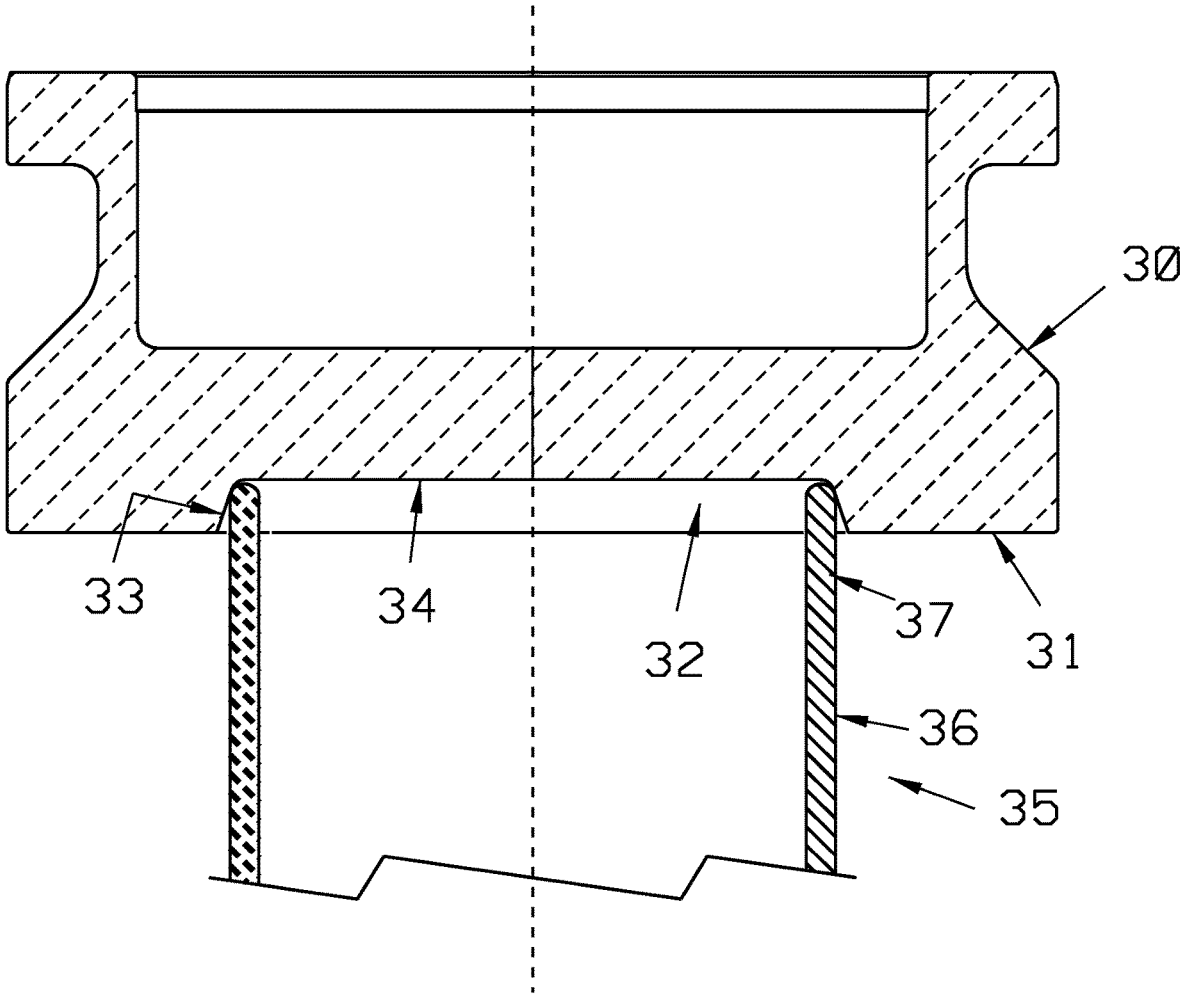
FIG. 4 shows the vertical cross-section of a cushion element in a fourth impact pile driving device equipped with the arrangement according to the invention, the pile being supported to the cushion element.

In FIG. 1, a steel pile 5 is placed against the supporting surface 4 of the cushion element 1. In this case, both the cushion element 1 and the steel pile 5 have a circular cross-section. The cushion element 1 shown in FIG. 1 is one that can be used, for example, in impact pile driving devices equipped with a block which is hydraulically or mechanically moved back and forth inside the hammer ram moving in the vertical direction along the derrick. It hits the impact surface 2 of the cushion element in the cap of the cushion element in the lower part of the hammer ram several times in succession during the driving of the pile 5 into the ground. The cushion elements shown in FIGS. 2 to 4 are also suitable, in principle, to be used in impact pile driving devices of e.g. the above mentioned type, but also in impact pile driving devices with a different principle of operation, such as diesel-powered and pneumatic pile driving devices.

The steel pile 5 shown in FIG. 1 is placed against the supporting surface 4 of the cushion element in such a way that its head is fitted against the absorbing surface 6 in the supporting surface of the cushion element 1. As seen in FIG. 1, the wall 8 of the pile 5 is in this case formed to be curved upwards at its upper end. Normally, the end of the wall 8 is not shaped in any way but it is straight; in some cases, however, it may also be made to match closely the shape of the absorbing surface 6. The end of the wall of the steel pile 5 may also have such a cross-section that it does not, right after fitting the steel pile 5 in its place, fit to abut tightly the absorbing surface 5, but an empty space may be left between e.g. the end of the wall 8 and the absorbing surface 6.

In this embodiment, the absorbing surface 6 is concave, because in this case the absorbing surface 6 is formed by the inner surface of a groove 7 formed in the supporting surface of the cushion element. The inner surface of this groove 7 is so wide and deep that at least the curved part 9 of the wall 8 of the steel pile 5 and, in the case of FIG. 1, also part of the side surfaces of the wall 8 extend entirely inside the cushion element 1 with respect to the rest of the absorbing surface 4. The inner wall of the groove 7, that is, the absorbing surface 6, touches the curved part of the wall 8 on a short section only, whereby when driving the steel pile 5 into the ground, the absorbing surface 6 shapes the end of the wall 8 of the steel pile 5 even during the first impacts, starting the deformation of the wall against the absorbing surface 6. Thus, in the step of placement against the cushion element of the impact pile driving device, the head of the steel pile 5 can sink into the groove 7 so that an empty space is left between the end of the wall and the bottom of the groove 7. Thus, the end of the wall 8 of the pile will sink to the bottom of the groove 7 during the first impacts. This will intensify the formation of the end of the wall and enable the head of the pile to fill the groove 7 more closely; in other words, enable the absorbing surface 6 to be placed against the side surfaces of the wall 8 on a larger area, whereby the absorption effect is enhanced further. Moreover, the groove 7 is shaped widening downwards. This will prevent the head of the steel pile 5 from being stuck in the groove 7, and enable the shaping of the head of the steel pile 5 to match the contours of the groove 7 as closely as possible. Thanks to the shape of the groove 7, the end of the wall 8 of the steel pile 5 will always be shaped to match the shape of the absorbing surface 6 formed by the inner wall of the groove 7 during the first impacts, even if it were not curved as shown in the figure but, for example, straight in the above mentioned way. However, the end of the wall 8 of the steel pile 5, following the contours of the absorbing surface, is shaped (expanded)

so that it is primarily only tightened against the absorbing surface 6; in other words, before starting the impact driving, the clearance between the end of the wall 8 and the groove 7 disappears and the end of the wall 8 is placed against the absorbing surface 6 over its whole area on the absorbing surface 6.

In the arrangement shown in FIG. 1, the material of the cushion element 1 can be clearly harder than the material of the wall 8 of the steel pile 5 (for example, tempered steel, or the like). Thus, the shape of the groove 7 in the supporting surface 4 of the cushion element 1 is not significantly changed upon driving the steel pile into the ground. Instead, upsetting and deformation take place in the wall 8 of the steel pile 5 right after the impact driving of the steel pile into the ground has been started, forming the head of the wall 8 and the adjacent walls 8 of the steel pile against the absorbing surface 6. As a result of the deformation, the curved end of the wall 8 and the straight side surfaces underneath it, at the absorbing surface 6, are formed against the absorbing surface 6 formed by the inner surface of the groove 7. Thus, the movement of the wall 8 in the direction transverse to the hammering direction of the steel pile 5 is prevented almost completely at the end of the steel pile 5. The resulting effect on the behaviour of the steel pile 5 is that the vibration of the steel pile 5 and the noise caused by it are significantly reduced.

The groove 7 in the supporting surface of the cushion element shown in FIG. 1 could also be narrower and lower than that shown in FIG. 1. In such a case, only part of the curved section 9 at the upper edge of the wall 8 of the steel pile 5 would extend into the cushion element. The groove 7 could also be deeper than that shown in FIG. 1, whereby a larger empty space can be formed between the end of the wall 8 and the bottom of the groove 7 than in the case of a low groove 7. Alternatively, the cushion element 1 could also be made of a softer material than the steel pile. In such a case, instead of or in addition to the walls of the steel pile, the groove 7 in the supporting surface would be shapeable by the impacts. Thus, right after the first impacts on the steel pile, the absorbing surface 6 would be shaped to follow the contours of the wall 8 of the steel pile 5 over the area of the part facing the absorbing surface 6 of the wall 8 so that the wall 8 of the steel pile 5 cannot significantly move in its cross direction, at least not in the area inserted in the groove 7. The material of such a shapeable cushion element could be, for example, some relatively slightly formable steel, aluminium or copper. Also, in such a solution, the groove 7 can be slightly narrower than the end of the steel pile 5 so that an empty space is left between the wall 8 and the bottom of the groove 7 when the steel pile 5 is fitted in place. During the first impacts, the material of the cushion element is shaped so that the end of the wall 8 is placed, over its whole area that is embedded in the cushion element 1, against the absorbing surface 6, whereby also in such a solution the whole absorbing surface 6 is evenly supported to that part of the wall 8 of the steel pile 5 which is thus embedded in the cushion element 1.

When driving the steel pile 5 into the ground by the impact pile driving device (of which only the cushion element of hard material is shown in FIG. 1), the steel pile 5 is placed against the ground at the impacting point and against the cushion element 1 as shown in FIG. 1 so that the curved part 9 of the upper edge of the wall 8 of the steel pile 5 is inserted into the groove 7 in the supporting surface 4 of the cushion element 1 as shown in FIG. 1. Already during the first impacts, the absorbing surface 6 formed by the inner surface of the groove 7 in the cushion element shapes the upper part of the wall 8 of the steel pile 5 to follow the contours of the absorbing surface 6 so that at least that part of the wall which is inserted into the groove 7 is supported to the absorbing surface 6. Further, if the end of the wall 8 of the steel pile 5 did not abut the bottom of the groove 7 at the step of mounting the steel pile 5, the end of the wall 8 is shaped so that it, too, will abut the bottom of the groove 7.

During the driving of the steel pile 5, mechanical impulses being transferred from the cushion element 1 to the steel pile 5 generate elastic deformations advancing in the form of impact-like deformation impulses in the steel pile 5. Because the walls 8 of the steel pile 5 are not ideally straight and/or of uniform thickness, they are also subjected to lateral forces, which tends to increase the vibration of the steel pile 5 and thereby the noise caused by it. However, the shaping of the side surfaces of the wall against the absorbing surface 6 in the above described way attenuates the movement caused by the lateral forces, because it prevents the upper edges of the walls of the steel pile 5 from moving in the cross direction of the steel pile 5, in the direction of the supporting surface of the cushion element, that is, in the direction transverse to the impacting direction. In this way, the arrangement shown in FIG. 1 braces the support of the steel pile 5 to the cushion element 1 and thereby reduces vibration and noise caused by the driving of the steel pile 5 into the ground.

FIG. 2 shows another embodiment of the arrangement according to the invention. Here, the cushion element corresponds to the cushion element 1 shown in the arrangement of FIG. 1 in other respects, but a separate auxiliary piece 13 is embedded in a recess 12 in the lower surface 11 of the cushion element 10, the lower surface of the auxiliary piece forming a supporting surface 14 provided with a groove 15. A steel pile 17 can be supported to an absorbing surface 16 formed by the inner surface of the groove 15. In this case, the recess 12 has the size and the shape of the auxiliary piece 13 so that basically no clearance is left between the auxiliary piece and the cushion element which would enable movement of the auxiliary piece inside the recess 12. Thus, the auxiliary piece 13 can be fastened in the recess 12 by e.g. a tight fit, by threading formed in the auxiliary piece 13 and in the recess 12, by screws, pins, or glue.

In the embodiment of FIG. 2, the auxiliary piece 13 can be made of such material that is harder than the rest of the cushion element, so that the absorbing surface 16 formed by the inner surface of the groove 15 in the auxiliary piece shapes the head and the side walls 18 of the steel pile 17 against the absorbing surface in the same way as in the embodiment of FIG. 1, but where hardly any stationary deformations are caused by the pressure from the head of the steel pile. Also, the material of the auxiliary piece 13 is advantageously such a material that is very resistant to wear caused by impact driving of the steel pile. A suitable material for the auxiliary piece 13 could be, for example, a hard and strong heat-treated alloy steel.

A separate auxiliary piece 13 similar to that shown in FIG. 2 has the advantage that the whole cushion element 10 does not need to be made of a material that is as hard and strong as the auxiliary piece 13. This reduces the manufacturing costs of the cushion element 10, and the wearing of the absorbing surface 16 will not require that the whole cushion element 10 is replaced, but as a regular maintenance operation it will be sufficient only to replace the auxiliary piece 13 as the wearing part.

FIG. 3 shows a third embodiment of the arrangement according to the invention. Here, the auxiliary piece 22 embedded in the lower surface of the cushion element, against which the wall 27 of a steel pile 26 having a circular cross-section is placed, has an annular shape. Also in this case, the recess 21 formed in the cushion element 20 has approximately the same size and shape as the auxiliary piece 22, and the material and fastening method of the auxiliary piece 22 can be similar to those in the embodiment of FIG. 2. In this case, the auxiliary piece 22 forming the wearing part is still smaller than the auxiliary piece of the embodiment of FIG. 2. As a result, the material costs of the wearing part are still lower in this embodiment than in the embodiment of FIG. 2. In this embodiment, the supporting surface 23 of the auxiliary piece, abutting the steel pile, and the absorbing surface 25 formed by the inner surface of the groove 24 therein, are all annular in shape. Normally, the supporting surface 23 is clearly wider than the groove 24 so that sufficiently thick and strong walls are formed between the groove 24 and the outer and inner edges of the auxiliary piece. The groove 24 is normally placed at the centre of the supporting surface 23 so that the distances from the inner edge of the auxiliary piece 22 to the inner edge of the groove 24, and from the outer edge of the auxiliary piece 22 to the outer edge of the groove 24, are approximately equal. However, an exception can also be made by placing the groove 24 so that either of the above mentioned distances is slightly greater than the other one.

FIG. 4 shows a fourth embodiment of the arrangement according to the invention. Here, the cushion element 30 is one similar to that shown in FIG. 1, without a separate auxiliary piece for forming the supporting surface abutting the steel pile. Also in this case, a steel pile 35 to be driven by it into the ground is a steel pile similar to those shown in the preceding figures. In the cushion element 30 according to this embodiment, the groove is replaced by a recess 32 formed in the supporting surface 31 and having a size determined by the outer diameter of the steel pile 35. The inner surface of the recess 32 constitutes an absorbing surface 33 for shaping the head of the steel pile 35, particularly the outer side surface 37 of its walls 36. For this, the inner surface of the recess 32 in the cushion element 30 of FIG. 4 is formed to be slightly wider in the direction of the steel pile 35 so that the diameter of the recess 32 at the supporting surface 31 is equal to or slightly larger than the outer diameter of the steel pile 35, but is slightly smaller than the outer diameter of the steel pile 35 at the bottom 34 of the recess 32. Thus, impact driving of the steel pile 35 into the ground will shape the outer surface of the wall 36 of the steel pile 35, already during the first impacts, to follow the surfaces extending from the supporting surface 31 towards the bottom 34 of the recess 32. This will provide the steel pile 35 with a supporting effect similar to that in the preceding embodiments, preventing lateral movements of the end of its wall.

In the embodiment of the arrangement according to FIG. 4, the absorbing surface 33 can also be slightly curved towards the walls of the steel pile 35 at the edge of the recess. This will facilitate the placement of the head of the steel pile in the correct position against the edges of the recess 32 when the steel pile 35 is being placed against the cushion element 30 of the impact pile driving device. Moreover, such a shape of the edge of the recess 32 will guide the end of the wall 36 of the steel pile 35 to extend into the recess 32 during the deformation of the end of the wall 36 during the first impacts.

The arrangement according to the invention can be implemented, in many respects, in a way different from the above described example embodiments. For example, the cross-section of the cushion element can have not only a circular shape but also a quadrangular, polygonal or different shape. The depth and the width of the groove or recess forming the absorbing surface in the supporting surface may vary. Typically, the groove forming the absorbing surface in the supporting surface has a depth of at least e.g. 30% of the thickness of the wall of the steel pile. In the case of a groove, its width is naturally dependent on the thickness of the wall of the steel pile. In some embodiments, e.g. several annular grooves forming the absorbing surface may be placed within each other. Such a cushion element is thus suitable for driving steel piles of different diameters into the ground. In embodiments similar to those shown in FIGS. 2 and 3, the auxiliary piece forming the supporting surface and the absorbing surface therein can have a cross section that is equal in shape with the cushion element (as in FIGS. 2 and 3), or different, if required by the cross-sectional shape of the steel piles to be driven into the ground. Further, in the embodiments of FIGS. 2 and 3, the auxiliary piece extends from the bottom of the recess to the level of the lower surface of the cushion element. In some such embodiments, however, the auxiliary piece may also extend beyond the lower surface of the cushion element or be lower than the recess so that a recess is left between the auxiliary piece and the cushion element, inside which recess the end of the steel pile is fitted before starting to drive the steel pile into the ground. Also, the steel pile can be implemented in a way different from a conventional steel pile. For the arrangement according to the invention, the steel pile can be implemented so that its end that will abut the supporting surface of the cushion element is equipped (e.g. by welding) with a particular end piece whose end that will abut the cushion element is shaped to match the absorbing surface in the supporting surface. Compared with a single-piece steel pile, such a steel pile has e.g. the advantage that the end piece can be made of softer steel than the other parts of the steel pile, whereby the steel pile can be made more resistant to loadings to which it is subjected, without increasing the thickness of the wall of the steel pile.

As mentioned in connection with the description of the embodiment of FIG. 1, the cushion element or the auxiliary piece therein can also be made of a material that is shaped when the head of the steel pile is placed against the cushion element and the impact driving of the steel pile is started. Such a solution is also possible in embodiments similar to FIGS. 2 to 4. Thus, the auxiliary piece to be installed in the recess formed in the lower surface of the cushion element to abut the steel pile, or the cushion element itself in embodiments of the type shown in FIG. 4, is made of such a material that is shaped at the beginning of impact driving of the steel pile so that the absorbing surface is primarily shaped, either instead of or together with the walls of the steel pile, to a shape in which the end and the side surfaces of the walls of the steel pile are against the absorbing surface over basically the whole area which, from the head of the steel pile, is inside the groove or recess. In such embodiments of the invention, the cushion element or the auxiliary piece embedded in a recess therein has to be made of a material that is sufficiently shapeable. This material could be e.g. a suitable metal, such as copper, aluminium or a suitable alloy. Moreover, the material of such a cushion element or auxiliary piece therein has advantageously such properties that it is resistant to recurring plastic deformations without work hardening and/or breaking so that the same cushion element or auxiliary piece can be preferably used for impact driving of several dozens of steel piles.

The above described arrangement according to the invention can be used in any impact pile driving device by which steel piles to be driven into the ground are driven in the above described way mechanically, hydraulically or in another way by means of a hammer ram based on a movable mass (block). Thus, with respect to the structure of the arrangement and the application of the method, the present invention should not be limited to the example embodiments but the invention can be implemented in a variety of different ways within the scope of the appended claims.

The invention claimed is:

1. A cushion element of an impact pile driving device:

comprising a flat impact surface, a side surface, and a supporting surface, and being made of material harder than steel of a steel pile to be impact driven;

the supporting surface having one or more grooves having an open end substantially on same level as the supporting surface and being wider than an end of a steel pile wall, and a bottom end being narrower than the end of the steel pile wall, and each groove having an inner surface forming an absorbing surface having a concave shape and each groove being configured to receive the end of the steel pile wall while leaving an empty space at bottom of the groove;

and wherein the cushion element is configured to deform the end of the steel pile during first impact pile hits on the flat impact surface, resulting in the absorbing surface becoming in close touch along its length with the deformed steel pile wall, and thus reducing vibration of the wall in a direction of a plane transverse to direction of impact pile driving of the steel pile and reducing noise level.

2. The cushion element according to claim 1 wherein the steel pile is formed of pipes with a circular, or rectangular cross section, or piles formed of open profiles with a sheet structure having a cross section of I, L, T, Z, or H.

3. The cushion element according to claim 1, wherein the cushion element comprises an auxiliary piece and the supporting surface and the absorbing surface therein are provided in the auxiliary piece.

4. The cushion element according to claim 3, wherein the cushion element is equipped with a recess, in which the auxiliary piece is fitted.

5. The cushion element according to claim 3 wherein the auxiliary piece is made of a material that is harder than the material of the cushion element.

6. The cushion element according to claim 3, wherein the steel piles are tubular piles, and the auxiliary piece is an annular piece.

7. The cushion element according to claim 6, wherein an inner diameter and an outer diameter of the auxiliary piece are selected so that an inner surface of the steel pile wall is spaced from an inner surface of the auxiliary piece, and an outer surface of the auxiliary piece is spaced from an outer surface of the steel pile wall.

8. A cushion element of an impact pile driving device comprising a flat impact surface, a side surface, and a supporting surface, and being made of material softer than steel of a steel pile to be driven;

the supporting surface having one or more grooves having an open end substantially on same level as the supporting surface and being wider than an end of a steel pile wall, and a bottom end being narrower than the end of the steel pile wall, and each groove having an inner surface forming an absorbing surface having a concave shape and being configured to receive the end of the steel pile wall while leaving an empty space at bottom of the groove;

and wherein the one or more grooves of the cushion element are configured to become deformed during first impact pile hits on the flat impact surface, resulting in the absorbing surface becoming in close touch along its length with the steel pile wall, and thus reducing vibration of the wall in a direction of a plane transverse to direction of impact pile driving of the steel pile and reducing noise level.

9. The cushion element according to claim 8, wherein the cushion element comprises an auxiliary piece, and the supporting surface and the absorbing surface therein are provided in the auxiliary piece.

10. An impact pile driving device, wherein the impact pile driving device comprises a cushion element according to claim 1 for supporting a thin-walled steel pile to a cushion element.

11. An impact pile driving machine, wherein the impact pile driving machine comprises a working machine and an impact pile driving device according to claim 10 mounted on it.

12. A method for arranging support of a steel pile in an impact pile driving device and reducing noise caused by impact pile driving, the method comprising:

providing a cushion element made of material harder than steel of the steel pile and having a flat impact surface, a side surface and a supporting surface, the supporting surface having one or more grooves, each groove having an inner surface forming an absorbing surface having a concave shape;

said one or more grooves being wider from their open end than from their bottom end, the open end being wider than an end of steel pile wall, and the bottom end being narrower than the end of the steel pile wall, and the supporting surface is substantially on same level as the open ends of the grooves; and placing the end of the steel pile wall at least partly against the absorption surface;

wherein by an effect of impact driving hit on the flat impact surface the end of the steel pile wall placed at least partly against the absorbing surface is shaped to match the concave shape of the absorbing surface, whereby vibration of the steel pile wall in direction of a plane transverse to the direction of impact driving of the steel pile is reduced and noise level of the impact driving is reduced.

13. The method according to claim 12 wherein the absorbing surface is formed onto the supporting surface in connection with casting and/or working, and/or by removing material from the supporting surface coming against the steel pile.

14. The method of claim 12, wherein the supporting surface is provided in an auxiliary piece separate from the cushion element fitted in a recess in the cushion element.

15. A method for arranging a support of a steel pile in an impact pile driving device and reducing noise caused by impact pile driving, the method comprising:

providing a cushion element made of material softer than steel of the steel pile and having a flat impact surface, a side surface and a supporting surface, the supporting surface having one or more grooves, each groove having an inner surface forming an absorbing surface having a concave shape, said one or more grooves being wider from their open end than from their bottom end, the open end being wider than an end of a steel pile wall, and the bottom end being narrower than the end of the steel pile wall, and the supporting surface is substantially on same level as the open ends of the grooves; and placing the end of the steel pile wall at least partly against the absorption surface;

wherein by an effect of an impact driving hit on the flat impact surface the concave shape of the absorption surface is shaped to match a shape of the end of the steel pile wall whereby vibration of the wall in the direction of a plane transverse to the direction of impact driving of the steel pile is reduced, and noise level of impact driving is reduced.

16. The method according to claim 15 wherein the absorbing surface is formed in the cushion element in connection with casting and/or working, and/or by removing material from the supporting surface of the cushion element coming against the steel pile.

17. The method of claim 15, wherein the supporting surface is provided in an auxiliary piece separate from the cushion element fitted in a recess in the cushion element.

18. An impact pile driving device, wherein the impact pile driving device comprises a cushion element according to claim 8.

* * * * *